US010351379B2

(12) United States Patent
Shirasaki

(10) Patent No.: US 10,351,379 B2
(45) Date of Patent: Jul. 16, 2019

(54) PAPER DISCHARGE APPARATUS FOR DISCHARGING CONVEYED PAPER, AND IMAGE FORMING APPARATUS EQUIPPED WITH SAME

(71) Applicant: KYOCERA Document Solutions Inc., Osaka (JP)

(72) Inventor: Seiichi Shirasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 74 days.

(21) Appl. No.: 15/693,073

(22) Filed: Aug. 31, 2017

(65) Prior Publication Data

US 2018/0057296 A1 Mar. 1, 2018

(30) Foreign Application Priority Data

Aug. 31, 2016 (JP) ..... 2016-168864

(51) Int. Cl.
*B65H 29/14* (2006.01)
*B41J 11/00* (2006.01)
(Continued)

(52) U.S. Cl.
CPC ..... *B65H 29/14* (2013.01); *B41J 11/00* (2013.01); *B41J 13/0009* (2013.01); *B41J 13/10* (2013.01);
(Continued)

(58) Field of Classification Search
CPC ..... B65H 29/14
(Continued)

(56) References Cited

U.S. PATENT DOCUMENTS 4,887,060 A * 12/1989 Kaneko ..... B65H 29/60 399/403
5,154,411 A * 10/1992 Saito ..... B65H 39/11 271/289
(Continued)

FOREIGN PATENT DOCUMENTS

JP 2000-072323 A 3/2000
JP 2005-306548 A 11/2005
(Continued)

OTHER PUBLICATIONS

Japan Patent Office. Office Action of foreign counterpart, dated May 28, 2019.

*Primary Examiner* — Anthony H Nguyen
(74) *Attorney, Agent, or Firm* — Hawaii Patent Services; Nathaniel K. Fedde; Kenton N. Fedde

(57) ABSTRACT

Provided is a paper-discharge apparatus that suppresses operating sound of the paper-discharge apparatus. A contact member changes the posture of the introduction guide by coming in contact with the introduction lever and rotating the introduction lever. A control unit sets a state in which paper is introduced to the paper-discharge-conveying unit to a non-contact state of the introduction lever and contact member, and sets a state when conveyed paper is guided to another discharge destination to a contact state of the introduction lever and the contact member. The control unit rotates the motor at a first speed and moves the contact member, and brings the contact member in contact with the introduction lever after setting the rotating speed of the motor to a second speed that is slower than the first speed.

8 Claims, 12 Drawing Sheets

(51) Int. Cl.

| | |
|---|---|
| ***B41J 13/00*** | (2006.01) |
| ***B41J 13/10*** | (2006.01) |
| ***B65H 31/20*** | (2006.01) |
| ***B65H 29/58*** | (2006.01) |
| ***B65H 39/11*** | (2006.01) |

(52) U.S. Cl.
CPC ..... *B65H 29/58* (2013.01); *B65H 31/20* (2013.01); *B65H 39/11* (2013.01); *B65H 2403/51* (2013.01); *B65H 2404/632* (2013.01); *B65H 2405/111* (2013.01); *B65H 2408/111* (2013.01); *B65H 2513/108* (2013.01); *B65H 2513/11* (2013.01); *B65H 2555/26* (2013.01); *B65H 2601/26* (2013.01); *B65H 2601/423* (2013.01); *B65H 2601/521* (2013.01); *B65H 2701/131* (2013.01); *B65H 2801/06* (2013.01)

(58) Field of Classification Search
USPC ..... 399/405
See application file for complete search history.

(56) References Cited

U.S. PATENT DOCUMENTS

| | | | | |
|---|---|---|---|---|
| 5,396,322 | A * | 3/1995 | Lawrence | B65H 39/11 271/291 |
| 6,308,952 | B1 * | 10/2001 | Takagi | B65H 31/22 271/297 |
| 6,325,371 | B1 | 12/2001 | Araki et al. | |
| 9,238,562 | B2 * | 1/2016 | Mori | B65H 15/00 |
| 10,054,893 | B2 * | 8/2018 | Kotani | B65H 39/11 |
| 2010/0001462 | A1 | 1/2010 | Matsuo | |
| 2015/0301490 | A1 * | 10/2015 | Takahashi | G03G 15/5016 399/405 |

FOREIGN PATENT DOCUMENTS

| | | | |
|---|---|---|---|
| JP | 2009-035409 | A | 2/2009 |
| JP | 2010-013249 | A | 1/2010 |
| JP | 2013-139331 | A | 7/2013 |

* cited by examiner

PAPER DISCHARGE APPARATUS FOR DISCHARGING CONVEYED PAPER, AND IMAGE FORMING APPARATUS EQUIPPED WITH SAME

INCORPORATION BY REFERENCE

This application is based on and claims the benefit of priority from Japanese Patent Application No. 2016-168864 filed on Aug. 31, 2016, the contents of which are hereby incorporated by reference.

BACKGROUND

The present disclosure relates to a paper-discharge apparatus for discharging conveyed paper, and an image-forming apparatus that is equipped with this paper-discharge apparatus.

An image-forming apparatus such as MFP, a printer, a copier, FAX and the like has plural bin trays (paper-discharge trays), and a paper-discharge apparatus for discharging printed paper that is conveyed from the main image-forming apparatus to one of the bin trays may be installed. In such a paper-discharge apparatus, plural path-switching members such as flappers are provided so that printed paper is discharged to a set bin tray as a discharge destination. There is a paper-discharge apparatus that has plural bin trays and switches the path according to the bin tray of the discharge destination.

More specifically, such a paper-discharge apparatus includes a protrusion that is integrally molded with a pulley and a belt around the pulley, a driving motor that drives the pulley and causes the belt to move around the protrusion, and sequentially pushes flappers up against the protrusion. By stopping the motor at a specified rotation position, an arbitrary flapper is deflected. When driving the switching flappers with solenoids, the number of solenoids needed is the same as the number of flappers, so attempts are being made to lower costs by reducing the number of parts by using a motor instead of solenoids.

SUMMARY

The paper-discharge apparatus according to claim 1 includes a paper-discharge-conveying unit, an introduction guide, an introduction lever, a contact member, a movement mechanism, a motor and a control unit. The paper-discharge-conveying unit conveys paper toward a discharge destination. A rotating shaft is provided in the introduction guide. The introduction lever is connected with the introduction guide by an introduction-lever-connection unit. The contact member changes the posture of the introduction guide by causing the introduction lever to pivot when coming in contact with the introduction lever. The movement mechanism causes the contact member to move. The motor moves the movement mechanism. The control unit controls the movement and position of the contact member by controlling the motor. When the state of the introduction guide is set to an introducing state in which conveyed paper is introduced to the paper-discharge-conveying unit, the control unit sets the introduction lever and the contact member state to a no-contact state, and when the state of the introduction guide is in a non-introducing state in which conveyed paper is not guided to the paper-discharge-conveying unit, but is guided to another discharge destination, the control unit sets the introduction lever and contact member to a contact state. The control unit, together with rotating the motor at a first speed and causing the contact member to move, causes the contact member to come in contact with the introduction lever after changing the rotation speed of the motor to a second speed that is slower than the first speed.

DETAILED DESCRIPTION

In the following, a paper-discharge apparatus 1 according to the present disclosure, and an image-forming apparatus that includes the paper-discharge apparatus 1 will be explained using FIG. 1 to FIG. 12. In the explanation below, an example of a MFP 100 as an image-forming apparatus will be explained. However, elements such as the configuration, arrangement and the like described in this embodiment do not limit the scope of the disclosure, and are simply an explanation example.

(Overview of an Image-Forming Apparatus)

Figure 1:
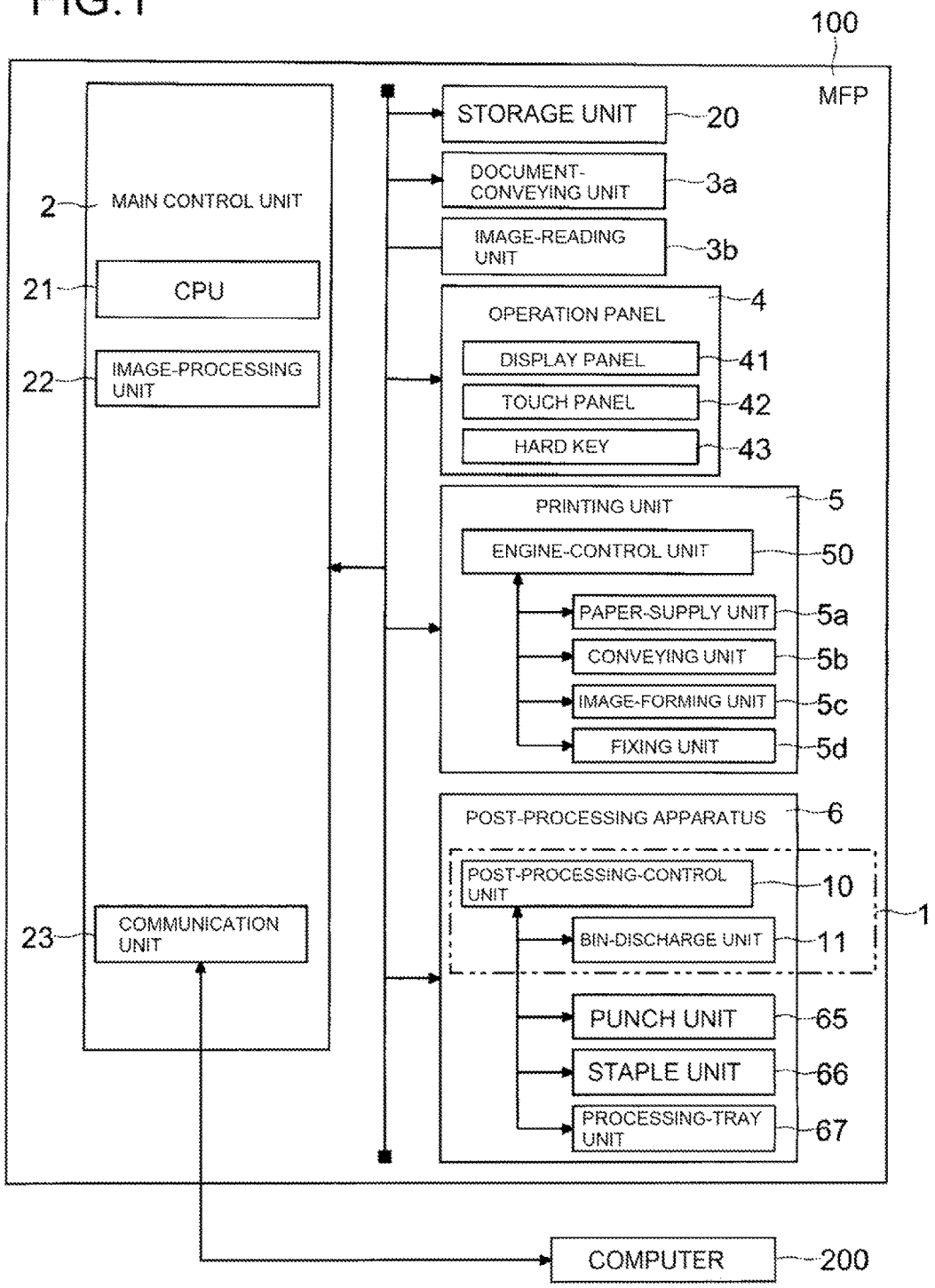
FIG. 1 illustrates an example of a MFP of an embodiment.

First, the MFP 100 of an embodiment will be explained based on FIG. 1. FIG. 1 illustrates an example of a MFP 100 of an embodiment.

The MFP 100 includes a main control unit 2 and a storage unit 20. The main control unit 2 takes charge of the overall operation of the apparatus, and controls each unit of the MFP 100. The main control unit 2 includes a CPU 21 for performing calculation and control, and an image-processing unit 22 that performs image processing of image data that is necessary for printing. The storage unit 20 includes a storage device such as ROM, RAM, HDD and the like, and stores control programs and data.

Moreover, the main control unit 2 is connected to a document-conveying unit 3*a* and image-reading unit 3*b* so that communication is possible. The document-conveying unit 3*a* conveys set documents to a reading position. The image-reading unit 3*b* reads a document that is conveyed by the document-conveying unit 3*a* or a document that is set on a platen glass (contact glass), and generates image data. The main control unit 2 controls the operation of the document-conveying unit 3*a* and the image-reading unit 3*b*.

The main control unit 2 is connected to an operation panel 4 so that communication is possible. The operation panel 4 includes a display panel 41, a touch panel 42, and hard keys 43. The main control unit 2 controls the display of the display panel 41. The main control panel 2 also recognizes an operation image that is being operated from among operation images such as software keys and buttons that are displayed on the display panel 41. Moreover, the main control unit 2 recognizes a hard key 43 that is being operated. The operation of the user is received by operating an operation image or hard key 43. For example, the user can set a discharge destination for the printed paper.

Furthermore, the MFP 100 includes a printing unit 5. The printing unit 5 includes an engine-control unit 50, a power-supply unit 5*a*, a conveying unit 5*b*, an image-forming unit 5*c*, and a fixing unit 5*d*. The engine-control unit 50 is connected to the main control unit 2 so that communication is possible; and the main control unit 2 gives a printing instruction, contents of a printing job, and image data to be used in printing to the engine-control unit 50. The engine-control unit 50 receives the instruction from the main control unit 2, and controls the operation of the paper-supply unit 5*a*, the conveying unit 5*b*, the image-forming unit 5*c* and the fixing unit 5*d*. More specifically, the engine-control unit 50 causes the paper-supply unit 5*a* to supply paper one sheet at a time. The engine-control unit 50 causes the conveying unit 5*b* to convey the supplied paper to the main discharge outlet 101 via the image-forming unit 5*c* and the fixing unit 5*d*. The engine-control unit 50 causes the image-forming unit 5*c* to form a toner image to be placed on the paper that is conveyed by the conveying unit 5*b*, and causes the image-forming unit 5*c* to transfer that toner image to the paper. The engine-control unit 50 causes the fixing unit 5*d* to fix the transferred toner image to the paper.

Moreover, a communication unit 23 is provided inside the main control unit 2. The communication unit 23 is an interface for communicating with a computer 200 such as a PC or a server. The communication unit 23 communicates with the computer 200 via a network. The communication unit 23 and computer 200 may be connected directly using a USB cable or the like so that communication is possible. The communication unit 23 receives printing data (print job data) from the computer 200 that includes data that indicates printing contents such as image data, and data that indicates settings for printing. The main control unit 2 causes the printing unit 5 to perform printing based on the printing data.

(Post-Processing Apparatus 6)

Figure 2:
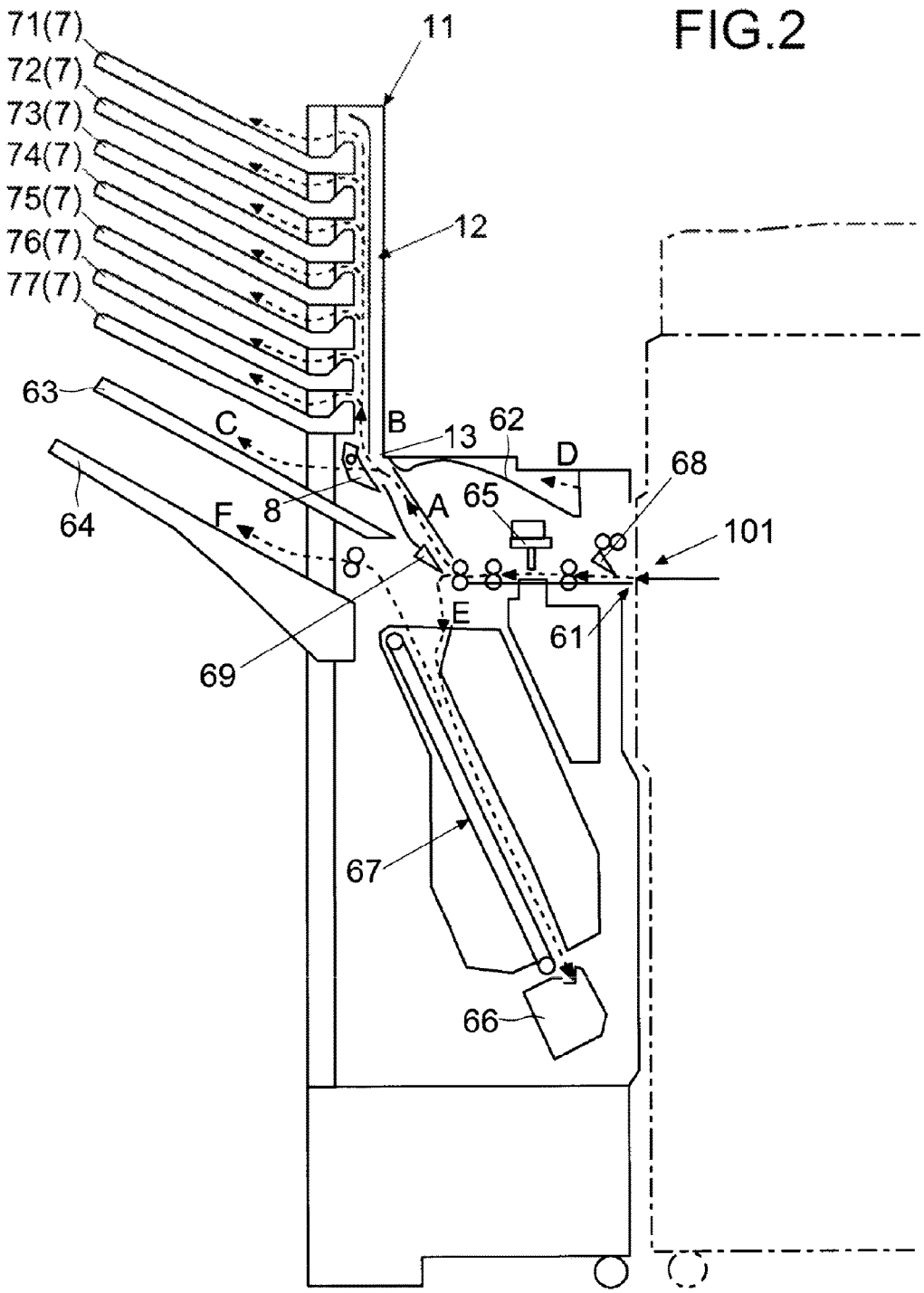
FIG. 2 illustrates an example of a post-processing apparatus of an embodiment.

Next, an overview of a post-processing apparatus 6 of an embodiment will be explained unit FIG. 1 and FIG. 2. FIG. 2 illustrates an example of a post-processing apparatus 6 of an embodiment.

The post-processing apparatus 6 is an apparatus for performing various kinds of post processing on printed paper. The post-processing apparatus 6 may be additionally attached to the main body of the MFP 100 as an optional apparatus.

The printed paper that passes the fixing unit 5*d* is discharged from the main discharge outlet 101, and is fed inside the post-processing apparatus 6 from the conveying inlet 61. As illustrated in FIG. 2, the post-processing apparatus 6 is provided with a bin-discharge unit 11, an upper-discharge tray 62, a first discharge tray 63, a second discharge tray 64, a punch unit 65, a staple unit 66, and a processing-tray unit 67. Moreover, the post-processing apparatus 6 is provided with a post-processing-control unit 10 (corresponds to the control unit) for controlling the operation of each unit of the post-processing apparatus 6.

The bin-discharge unit 11 has plural bin trays 7. As illustrated in FIG. 2, the bin-discharge unit 11 has from the top a first bin tray 71, a second bin tray 72, a third bin tray 73, a fourth bin tray 74, a fifth bin tray 75, a sixth bin tray 76 and a seventh bin tray 77, for a total of seven bin trays 7. It is also possible to have six or less, or eight or more bin trays 7.

In the operation panel 4 it is possible to set a bin tray 7 to be assigned to a user. Data that indicates which bin tray 7 is assigned to which user is stored in the storage unit 20. In the case of a copying job, the main control unit 2 recognizes the user based on the user name and password that are entered on the operation panel 4. In the case of a printing job, the main control unit 2 recognizes the user based on the computer 200 that transmitted printing data to the MFP 100. The control unit 2 notifies the post-processing-control unit 10 of the person executing printing and the bin tray 7 that is assigned to that person executing printing. In a printing job for which discharging paper to a bin tray 7 is set, the post-processing-control unit 10 causes the paper to be discharged to the bin tray 7 that is assigned to the person executing the current printing job.

The upper discharge tray 62 is provided on the right side of the bin-discharge unit 11 in between the conveying inlet 61 and the bin-discharge unit 11, and is provided on the top surface of the post-processing apparatus 6. The first discharge tray 63 is provided below the seventh bin tray 77, and is a tray where paper is discharged. The second discharge tray 64 is provided below the first discharge tray 63, and is a tray where paper is discharged. The punch unit 65 is a portion that performs a process for punching holes in the paper. The processing-tray unit 67 is a portion that stacks paper in bundles in units of the number of sheets. The staple unit 66 is a portion that performs a process for stapling the paper bundles in the processing tray unit 67.

Figure 3:
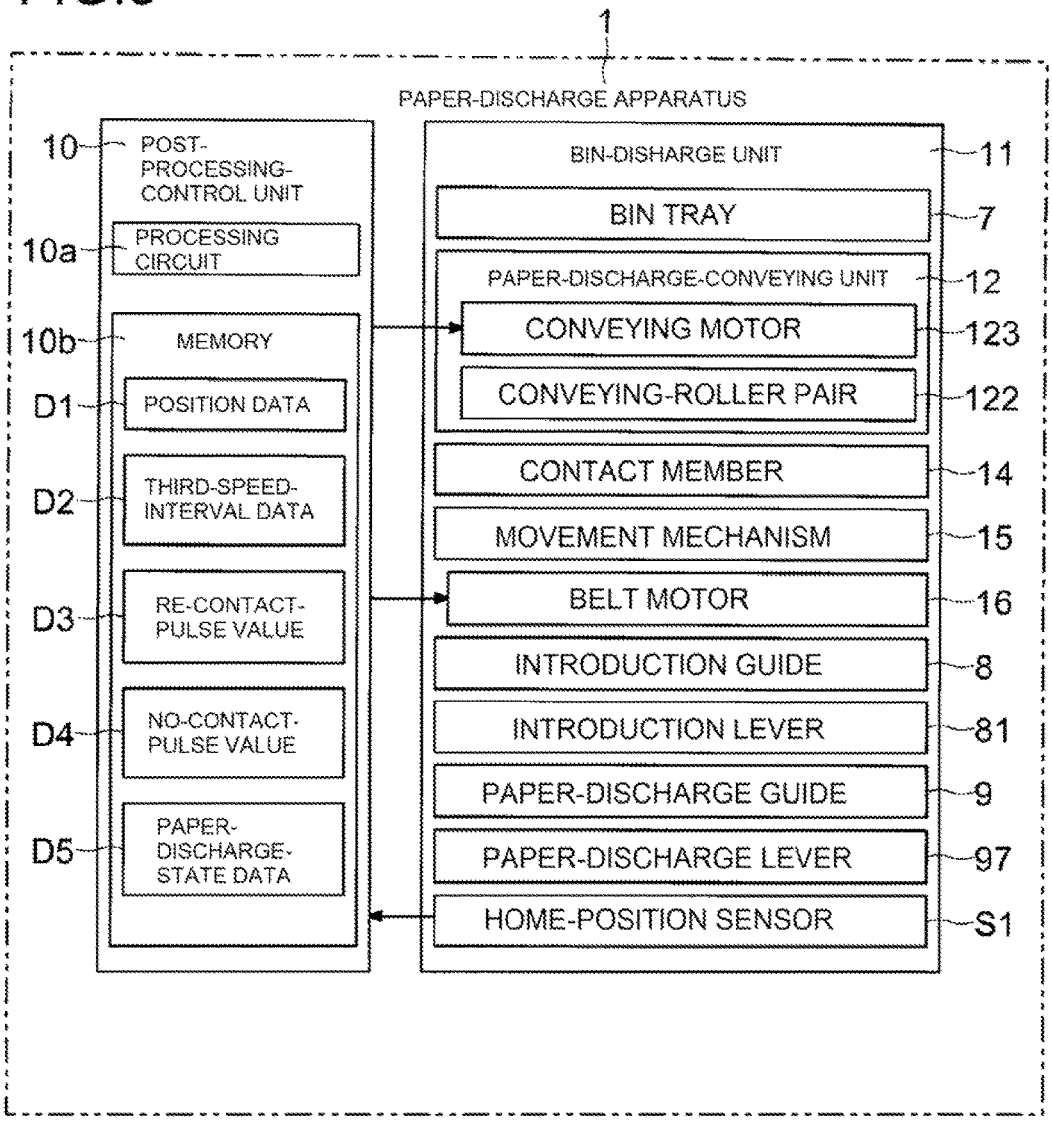
FIG. 3 illustrates an example of a paper-discharge apparatus of an embodiment.

The post-processing-control unit 10 is circuit board that includes a processing circuit 10*a* such as a CPU or microcomputer, and a memory 10*b* (refer to FIG. 3). It is also possible to not provide a post-processing-control unit 10 in the post-processing apparatus 6, and for the main control unit 2 that is provided in the main MFP 100 to control the operation of the post-processing apparatus 6.

Plural roller pairs for conveying paper are provided inside the post-processing apparatus 6. Each roller pair is rotated by receiving a driving force of a motor. The post-processing-control unit 10 causes the roller pairs to rotate and convey the paper inside the post-processing apparatus 6.

In order to sort the conveying destination for paper by the post-processing apparatus 6, a first sorting guide 68 and a second sorting guide 69 are provided. The first sorting guide 68 is provided near the conveying inlet 61. The second sorting guide 69 is provided between the conveying inlet 61 and the processing-tray unit 67. A motor is respectively provided for both the first sorting guide 68 and the second sorting guide 69, and each can be respectively rotated. The post-processing-control unit 10 causes the first sorting guide 68 and the second sorting guide 69 to rotate according to settings on the operation panel 4.

When discharging to the bin trays 7 or the first discharge tray 63 is set on the operation panel 4, the post-processing-control unit 10 causes the paper to be conveyed toward the bin-discharge unit 11 and first discharge tray 63. More specifically, the post-processing-control unit 10 causes the first sorting guide 68 and second sorting guide 69 to rotate so that that after passing the punch unit 65, the conveying direction is toward the bin-discharge unit 11 (arrow A in FIG. 2).

Moreover, an introduction guide 8 is provided below (front of) the bin-discharge unit 11. When discharging paper to the bin-discharge unit 11 (one of the bin trays 7) is set on the operation panel 4, the post-processing-control unit 10 sets the introduction guide 8 to a posture for introducing paper inside the bin-discharge unit 11. As a result, paper that is conveyed toward the bin-discharge unit 11 is introduced into a paper-discharge-conveying unit 12 inside the bin-discharge unit 11 (arrow B in FIG. 2), and discharged to one of the bin trays 7. However, when discharging paper to the first discharge tray 63 is set on the operation panel 4, the post-processing-control unit 10 sets the introduction guide 8 to a posture that closes the introduction inlet 13 to the bin-discharge unit 11. As a result, paper is discharged toward the first bin-discharge tray 63 (arrow C in FIG. 2).

On the other hand, when discharging to the upper-discharge tray 62 is set on the operation panel 4, the post-processing-control unit 10 causes the first sorting guide 68 to rotate so that paper that is conveyed upward from the conveying inlet 61 is discharged to the upper-discharge tray 62 (arrow D in FIG. 2). Normally, A4 sized paper is discharged to the upper-discharge tray 62.

When performing a staple process is set on the operation panel 4, the post-processing-control unit 10 causes the first sorting guide 68 and the second sorting guide 69 to rotate so that paper is guided in the direction of the processing-tray unit 67 (arrow E in FIG. 2). The post-processing-control unit 10 causes a paper bundle after the staple process by the staple unit 66 to move backward and be discharged to the second discharge tray 64 (arrow F in FIG. 2). A raising and lowering mechanism for raising or lowering the second discharge tray 64 is provided. There is also a sensor that detects the height of paper placed in the second discharge tray 64. The post-processing-control unit 10 by the sensor detects the height of the paper. The post-processing-control unit 10 controls the raising and lowering mechanism. The post-processing-control unit 10 positions the second discharge tray 64 according to the paper height.

(Paper Discharge Apparatus 1)

Figure 4:
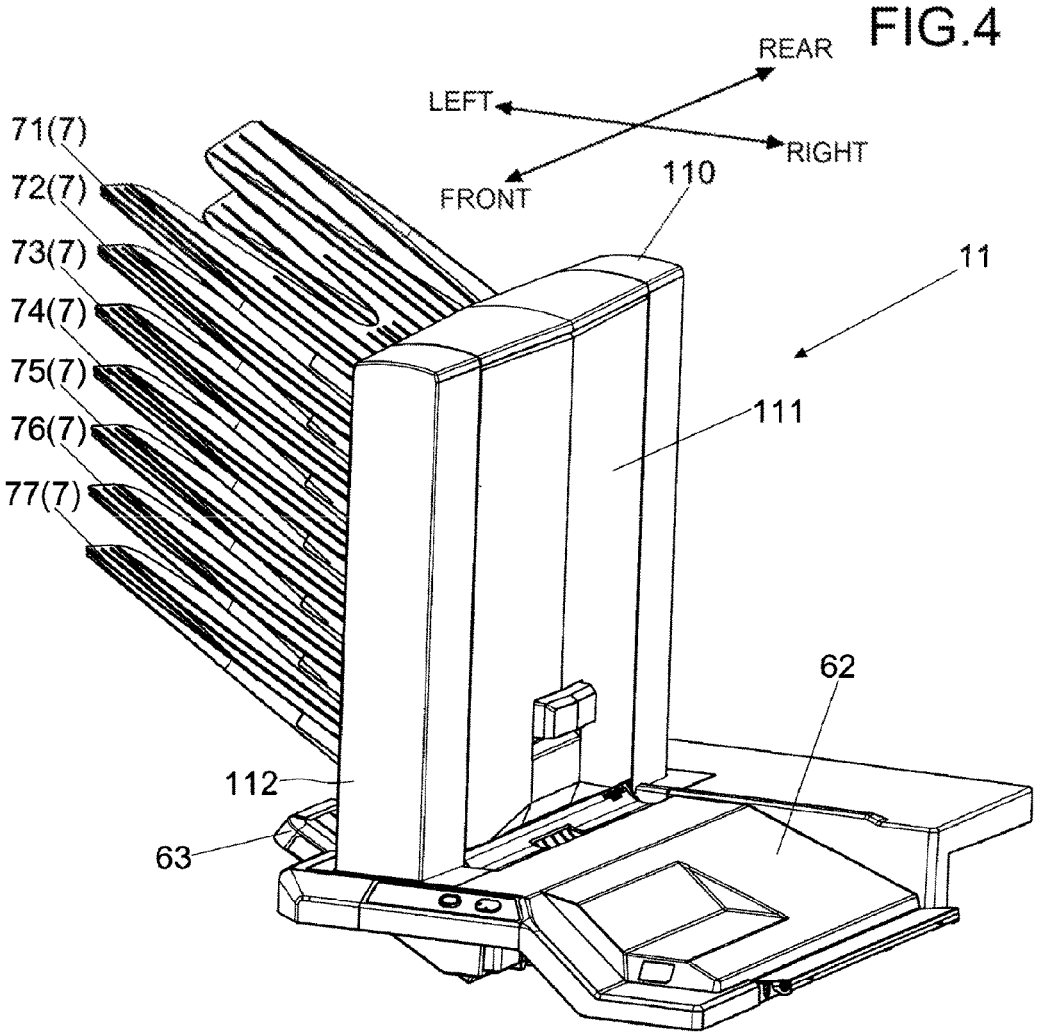
FIG. 4 illustrates an example of a bin-discharge unit of an embodiment.
Figure 5:
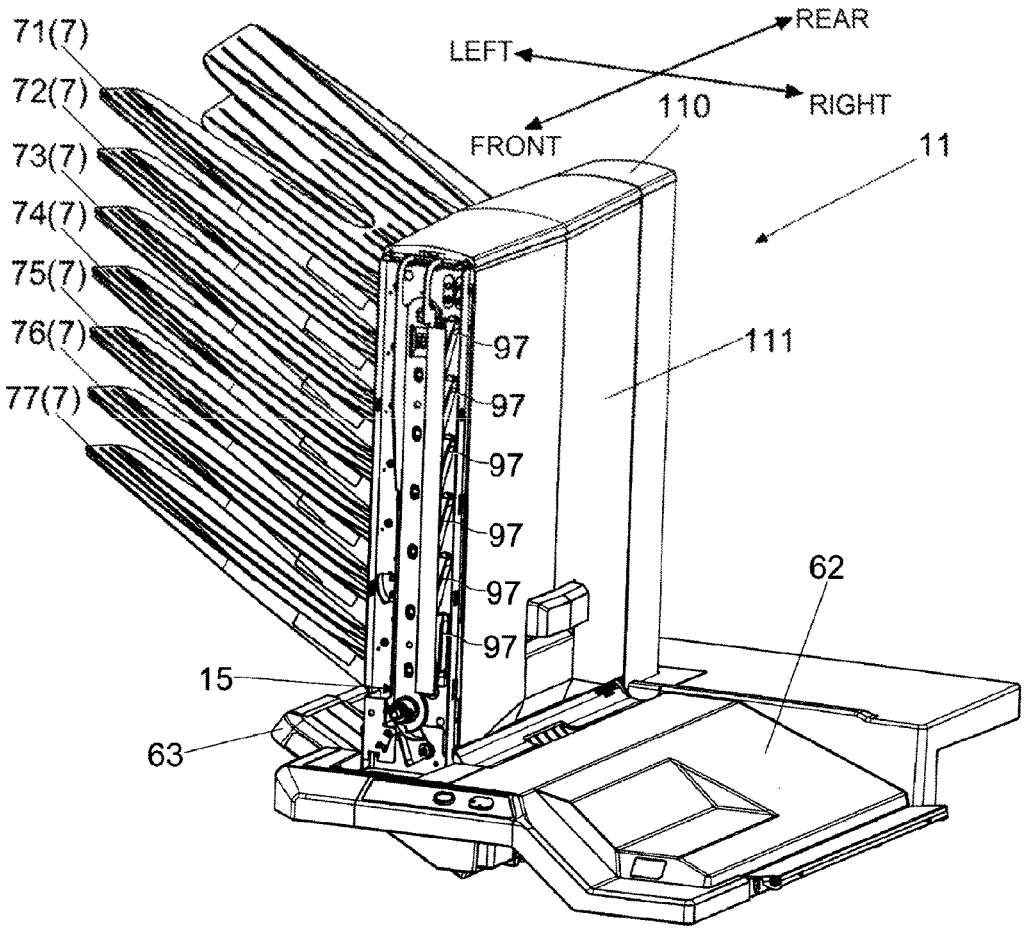
FIG. 5 illustrates an example of a state in which the front cover is removed from a bin-discharge unit of an embodiment.
Figure 6:
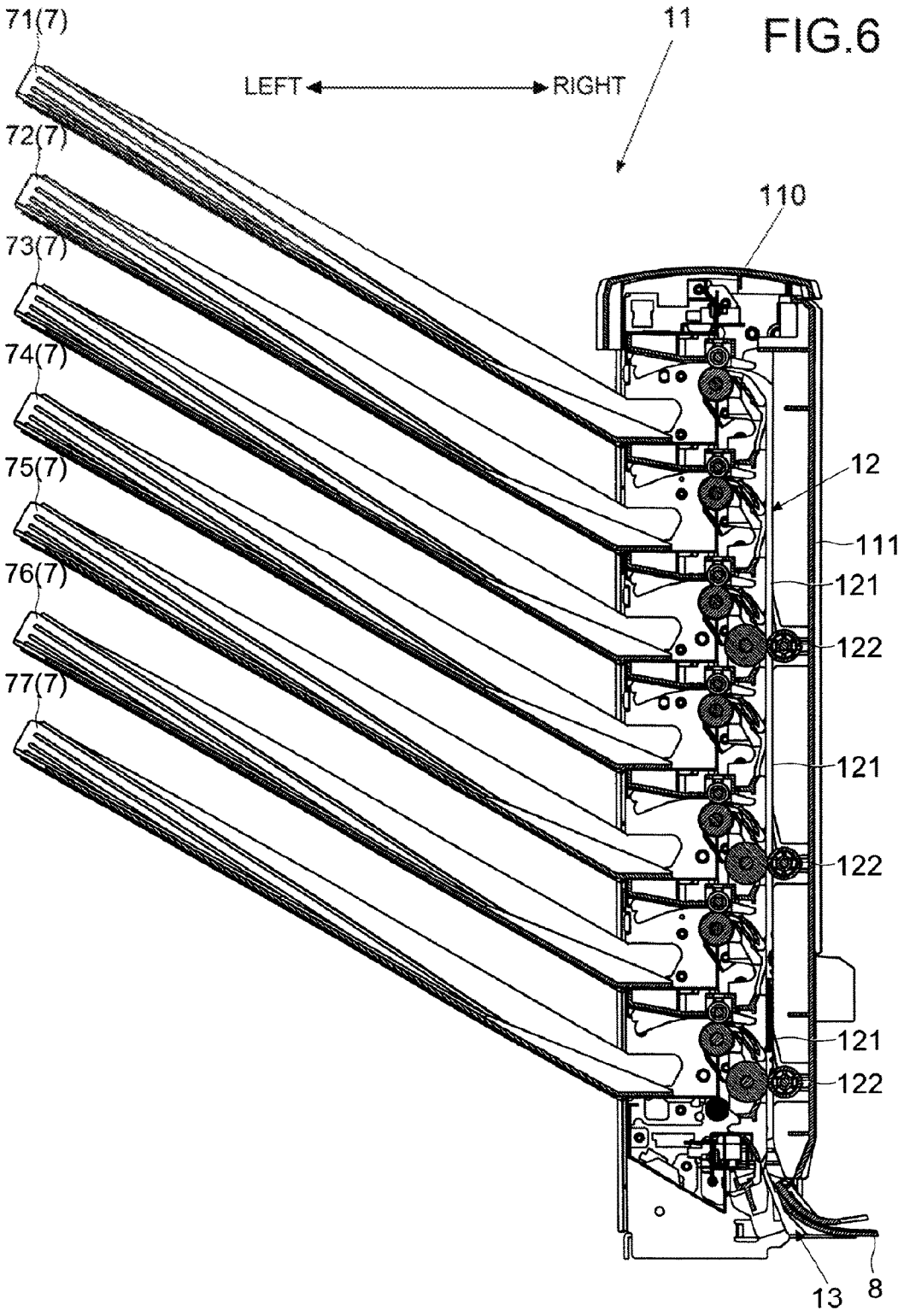
FIG. 6 illustrates an example of discharge-conveying path inside a bin-discharge unit of an embodiment.
Figure 7:
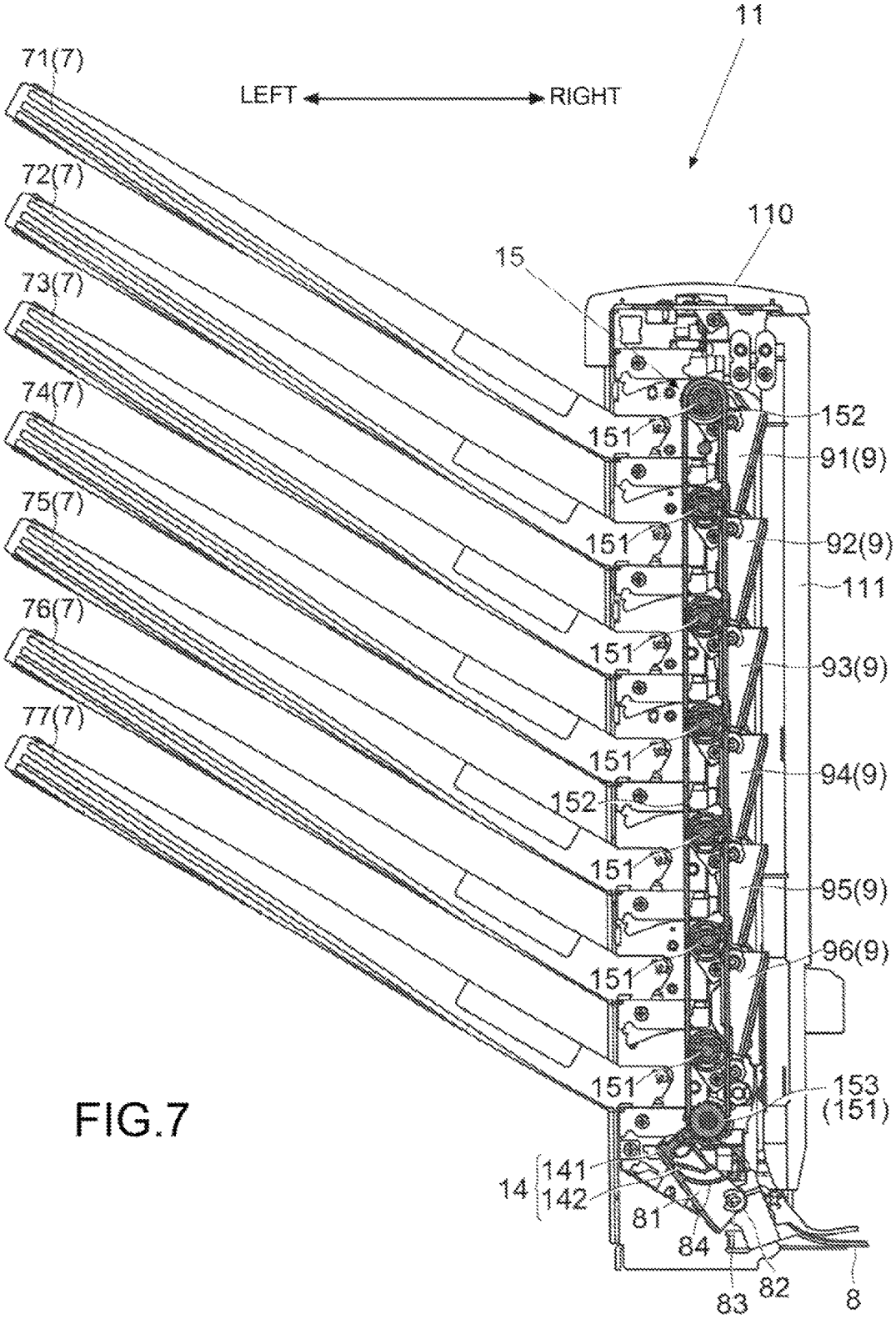
FIG. 7 illustrates an example of a non-introducing state of an introduction guide of an embodiment.
Figure 8:
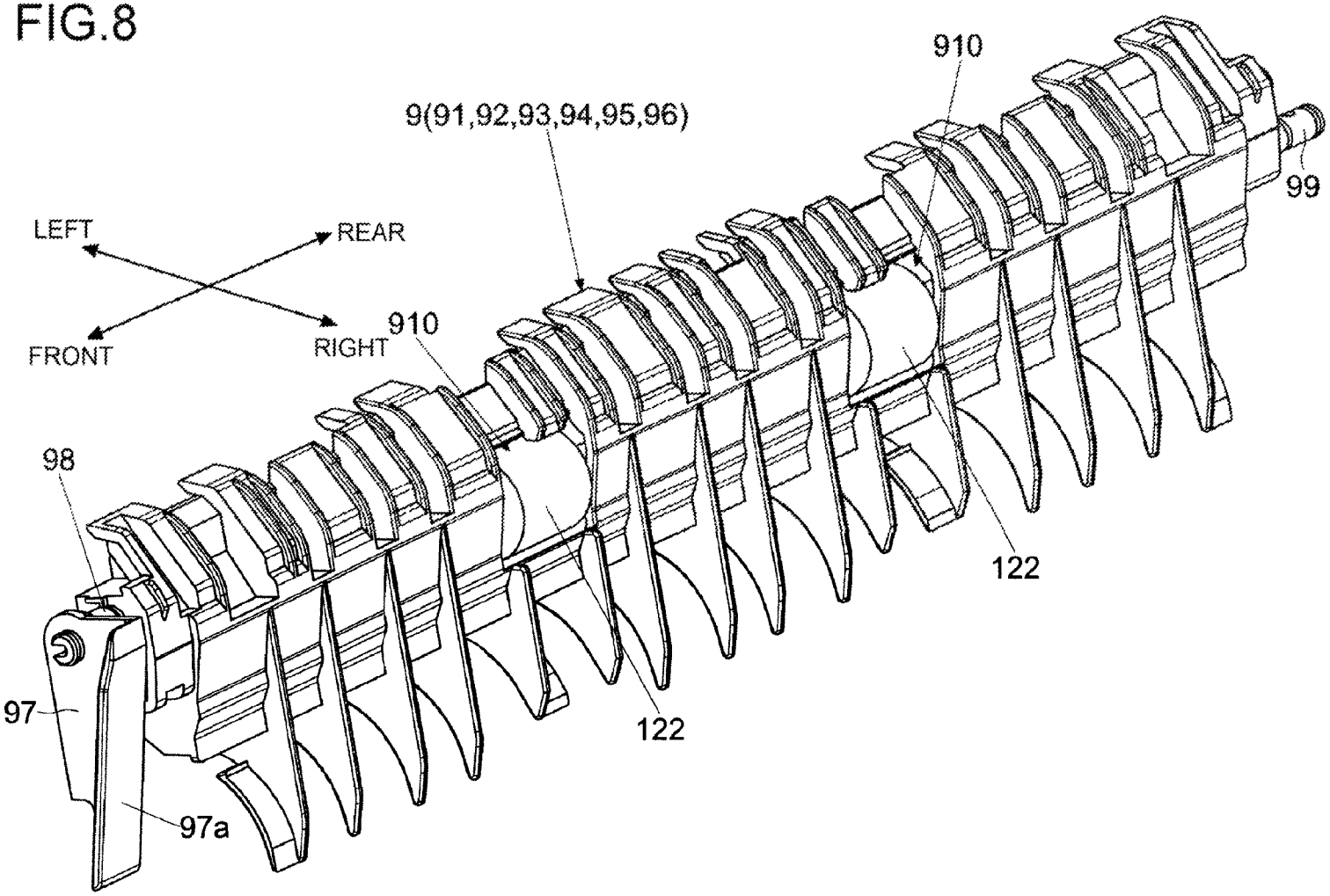
FIG. 8 illustrates an example of a paper-discharge guide of an embodiment.
Figure 9:
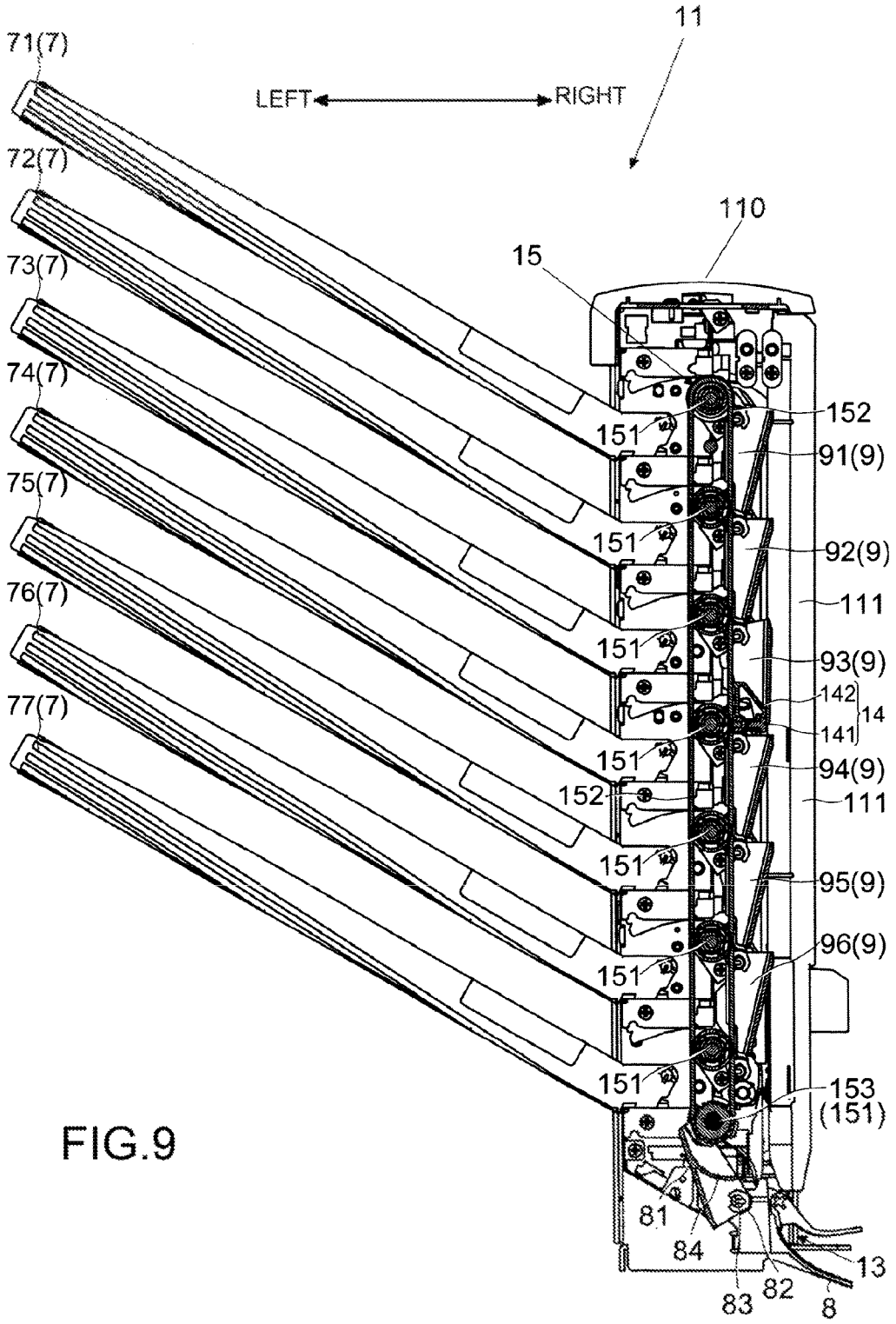
FIG. 9 illustrates an example of an introducing state of an introduction guide of an embodiment.
Figure 10:
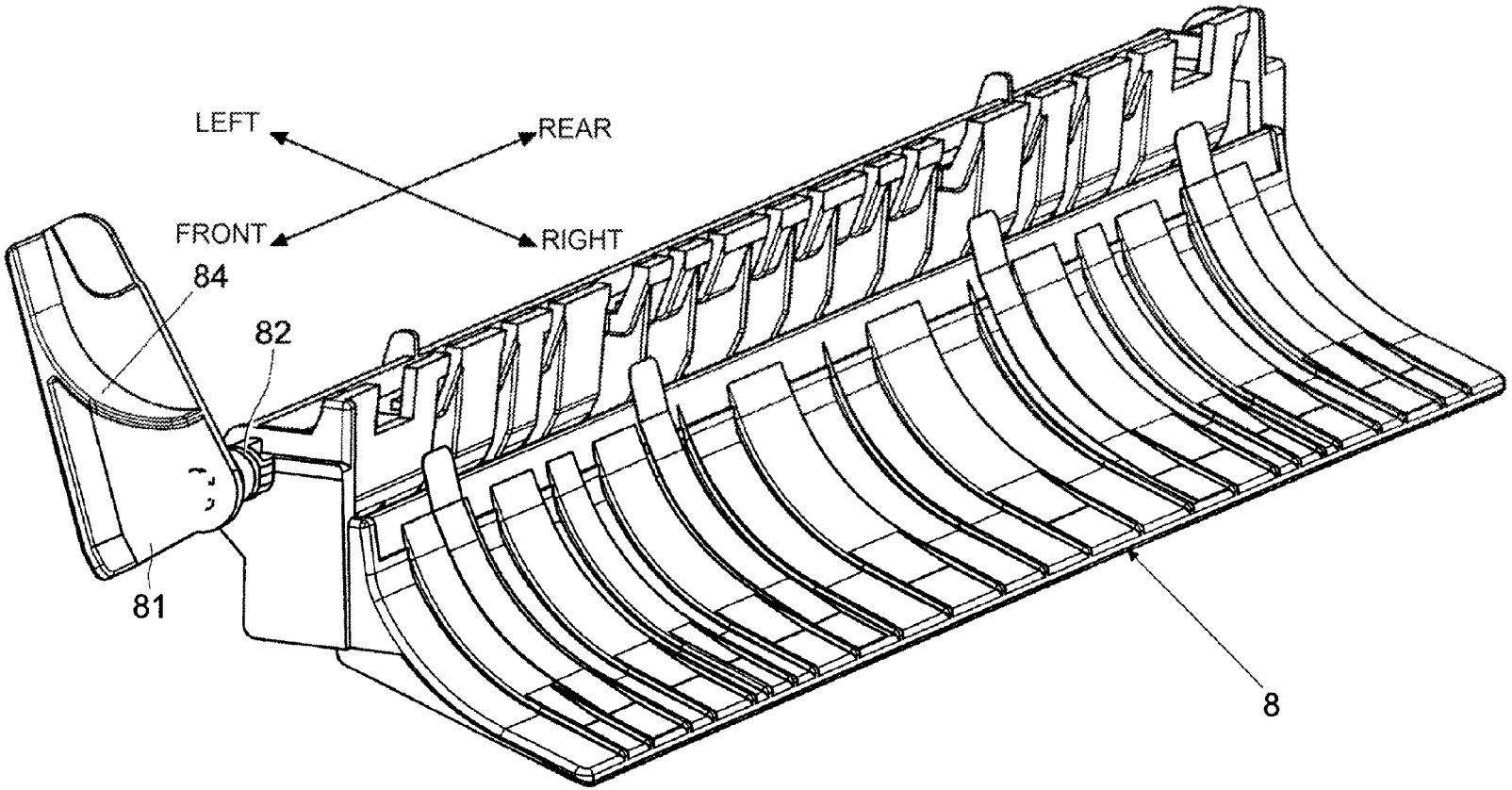
FIG. 10 illustrates an example of an introduction guide and introduction lever of an embodiment.
Figure 11:
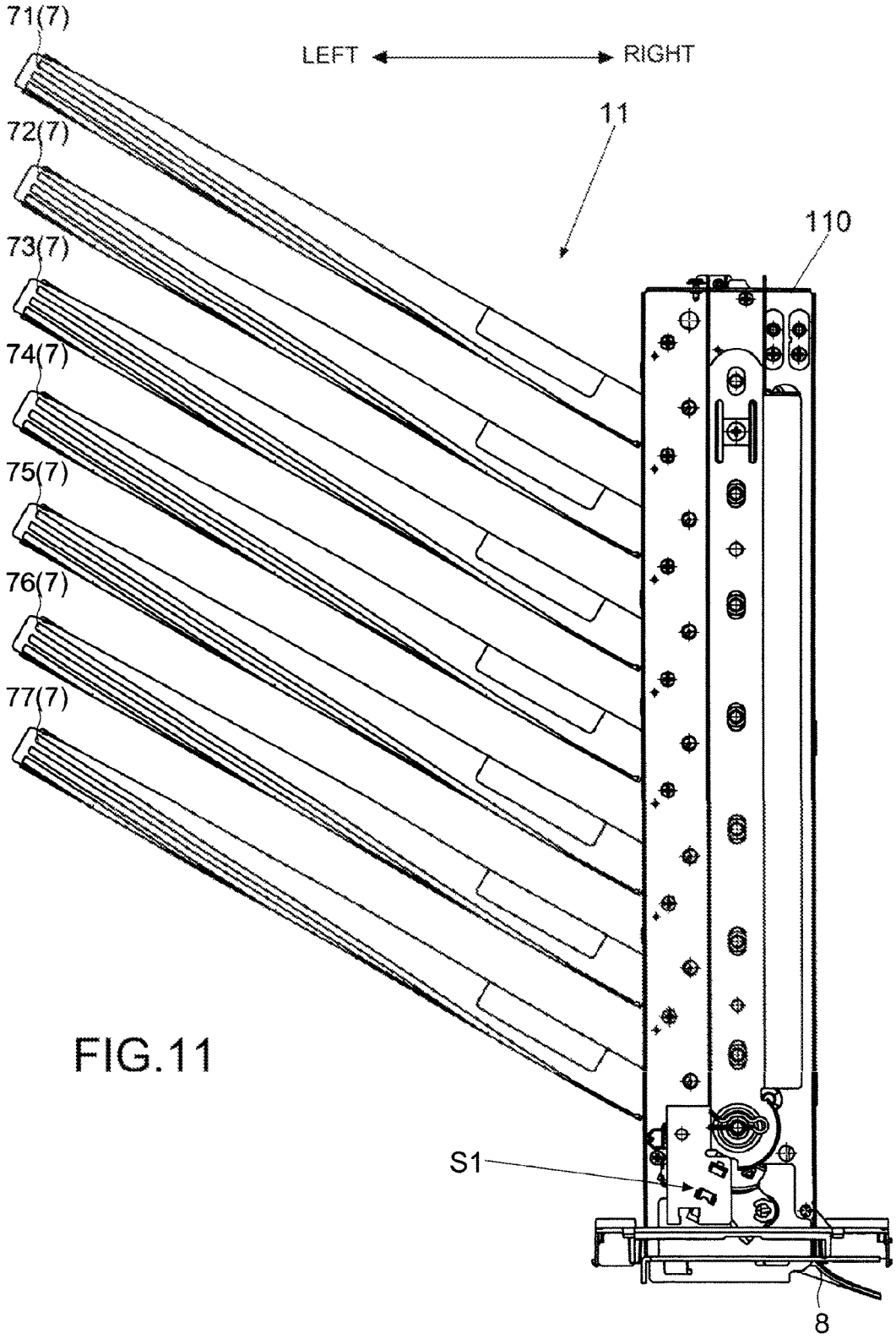
FIG. 11 illustrates an example of an installation position of a home-position sensor of an embodiment.

Next, an example of a paper discharge apparatus 1 of an embodiment will be explained using FIG. 3 to FIG. 11. FIG. 3 illustrates an example of a paper discharge apparatus 1 of an embodiment. FIG. 4 illustrates an example of a bin-discharge unit 11 of an embodiment. FIG. 5 illustrates an example of a state in which the front cover is removed from a bin-discharge unit 11 of an embodiment. FIG. 6 illustrates an example of a paper-discharge-conveying unit 12 inside a bin-discharge unit 11 of an embodiment. FIG. 7 illustrates an example of a non-introducing state of an introduction guide 8 of an embodiment. FIG. 8 illustrates an example of a paper-discharge guide 9 of an embodiment. FIG. 9 illustrates an example of an introducing state of an introduction guide 8 of an embodiment. FIG. 10 illustrates an example of an introduction guide 8 and introduction lever 81 of an embodiment. FIG. 11 illustrates an example of an installation position of a home-position sensor S1 of an embodiment.

In FIG. 4, FIG. 5, FIG. 8 and FIG. 10 there are arrows that indicate front, rear, left and right. FIG. 6, FIG. 7, FIG. 9 and FIG. 11 are views of the paper discharge apparatus 1 as seen from the front side (front surface). In FIG. 6, FIG. 7, FIG. 9 and FIG. 11 there are arrows that indicate left and right. The front, rear, left and right correspond to the front (front surface), rear (rear surface), left (left side surface), and right (right side surface) of the paper discharge apparatus 1, post-processing apparatus 6 and MFP 100.

As illustrated in FIG. 3, the paper discharge apparatus 1 of an embodiment includes a bin-discharge unit 11, and a post-processing-control unit 10 that controls the operation of the bin-discharge unit 11. The bin-discharge unit 11 includes each of the bin trays 7 (first bin tray 71 to seventh bin tray 77), a paper-discharge-conveying unit 12, a contact member 14, a moving mechanism 15, a belt motor 16 (corresponds to a motor), an introduction guide 8, an introduction lever 81, a paper-discharge guide 9, and a paper-discharge lever 97. These members will be described in detail later.

As illustrated in FIG. 4, the bin-discharge unit 11 has a frame 110, the lengthwise direction of which is in the vertical direction. The bin trays 7 are provided on the left side of this frame 110. The spacing in the vertical direction between each of the bin trays 7 is equal or mostly equal. Each bin tray 7 is such that the upstream side in the paper discharge direction is connected to the frame 110, and the downstream side in the paper discharge direction is inclined upward to the left. Except for the first bin tray 71, one paper-discharge guide 9 is provided inside the frame 110 corresponding to one bin tray 7. By changing the posture of the paper-discharge guide 9, paper is discharged to the bin tray 7 that is set as the discharge destination.

As illustrated in FIG. 4, an opening/closing plate 111 is provided on the right side of the frame 110. The opening/closing plate 111 can be opened in order to perform maintenance or to remove jammed paper. FIG. 5 illustrates a state in which a front-side cover 112 on the front side (front surface side) of the frame 110 is removed. A moving mechanism 15 that rotates and moves the contact member 14 that change the posture of the paper-discharge guides 9 is provided on the front side of the frame 110.

Furthermore, as illustrated in FIG. 6, a paper-discharge-conveying unit 12 that conveys paper is provided inside the frame 110. The paper-discharge-conveying unit 12 is provided on the inside of the opening/closing plate 111. The paper-discharge-conveying unit 12 includes a paper-discharge-conveying path 121 that extends in the vertical direction, plural conveying-roller pairs 122, and conveying motors 123 that rotate the conveying-roller pairs 122 (Refer to FIG. 3). The paper-discharge-conveying unit 12 conveys paper that is introduced from the introduction inlet 13 (introduction inlet 13 for paper to the paper-discharge-conveying unit 12) that is provided at the bottom part of the frame 110 upward.

As illustrated in FIG. 7, a total of six paper-discharge guides 9 are provided. In order from the top, a first paper-discharge guide 91, a second paper-discharge guide 92, a third paper-discharge guide 93, a fourth paper-discharge guide 94, a fifth paper-discharge guide 95 and a sixth paper-discharge guide 96 are provided. The first paper-discharge guide 91 corresponds to the second bin tray 72. The second paper-discharge guide 92 corresponds to the third bin tray 73. The third paper-discharge guide 93 corresponds to the fourth bin tray 74. The fourth paper-discharge guide 94 corresponds to the fifth bin tray 75. The fifth paper-discharge guide 95 corresponds to the sixth bin tray 76. The sixth paper-discharge guide 96 corresponds to the seventh bin tray 77.

Each paper-discharge guide 9 is the same. FIG. 8 is an enlarged view of a paper-discharge guide 9. A paper-discharge-lever-connection unit 98 for connecting the paper-discharge lever 97 is provided on one end in the lengthwise direction (end section on the front side) of each paper-discharge guide 9. The paper-discharge-lever-connection unit 98 is a portion where tubular connecting tube that is provided on the paper-discharge lever 97 is fixedly fitted around a column shaped protrusion (not seen) that is integrally formed and processed with the main body of the paper-discharge guide 9 that is made using resin. The paper-discharge lever 97 and the paper-discharge guide 9 are connected by the paper-discharge-lever-connection unit 98. The paper-discharge lever 97 is such the cross-section thereof in a direction parallel to the axis of rotation is an L shape.

As illustrated in FIG. 8, a penetrating rotating shaft 99 is provided in the paper-discharge guide 9. In FIG. 8, the rotating shaft 99 on the front side cannot be seen because of the paper-discharge lever 97. The rotating shaft 99 is supported by bearings. As a result, each paper-discharge guide 9 is able to rotate.

Moreover, opening sections 910 are provided at two locations in the paper-discharge guide 9. The roller on the bin tray 7 side of the conveying-roller pair 122 is placed in (fitted in) the opening section 910. The paper-discharge guide 9 rotates in the clockwise direction as seen from the front side (front surface), and a state in which conveyance of paper by the paper-discharge-conveying unit 12 is not blocked is the retracted state. In the retracted state, paper is conveyed while coming in contact with the surface (tab shaped fin) on the right side (opposites side from the bin tray 7) of the paper-discharge guide 9. The paper-discharge guide 9 is pressed by a biasing member such as a torsion spring, and the retracted state is taken to be the basic posture. In other words, normally, the paper-discharge guide 9 is in the retracted state.

However, a state in which the paper-discharge guide 9 rotates in the counterclockwise direction as seen from the front side and protrudes into the paper-conveying path of the paper-discharge-conveying unit 12 is the paper-discharge state. Paper is discharged to the bin tray 7 that corresponds to the paper-discharge guide 9 that is in the paper-discharge state.

A contact member 14 and a moving mechanism 15 that moves the contact member 14 are provided inside the front-side cover 112 further on the outside (front side) than the paper-discharge guide 9. The moving mechanism 15 includes pulleys 151 and a continuous belt 152 that is placed around these pulleys 151. The contact member 14 is provided on the continuous belt 152.

As illustrated in FIG. 7 and FIG. 9, the contact member 14 is a combination of a protruding section 141 having a T-shaped cross-section that is integrally formed (formed as an insert) around a protrusion that is provided on the continuous belt 152 beforehand, and an engaging member 142 that is a resin member having a trapezoidal (triangular) cross-section that is attached to the protruding section 141 and fits into the protruding section 141.

Of the plural pulleys 151, the very bottom pulley 151 is a driving pulley 153. Teeth are provided on the driving pulley 153. Teeth are also provided around the inner circumference of the continuous belt 152, and the teeth of the driving pulley 153 engage with the teeth of the continuous belt 152. The driving pulley 153 receives the driving of the belt motor 16 (refer to FIG. 3) and rotates. The continuous belt 152 rotates due to the rotation of the driving pulley 153. The post-processing-control unit 10 controls the movement and position of the contact member 14 by controlling the belt motor 16. The contact member 14 moves (circulates) due to the circulation of the continuous belt 152. The direction of circulation of the contact member 14 and the continuous belt 152 is clockwise circulation as seen from the front side (front surface).

Due to the circulation of the continuous belt 152, the contact member 14 comes in contact with (interferes with) the paper-discharge lever 97. The contact between the paper-discharge lever 97 and the contact member 14 causes the posture of the paper-discharge guide 9 to displace from the retracted state to the discharge state. In other words, each paper-discharge lever 97 is provided part way along the course of the contact member 14. FIG. 5 illustrates a state in which part of the paper-discharge lever 97 can be seen. Of the paper-discharge lever 97 that is illustrated in FIG. 8, the portion of a contact plate 97*a* that is formed so as to bend forward comes in contact with the contact member 14. When the contact member 14 comes in contact with the contact plate 97*a*, the contact member 14 pushes the paper-discharge lever 97 to the right side as seen from the front side (side protruding into the paper-discharge-conveying path 121). As a result, the paper-discharge guide 9 rotates in the counterclockwise direction as seen from the front surface.

The paper-discharge lever 97 is pushed by the biasing member in the clockwise direction as seen from the front side, and the paper-discharge guide 9 is maintained in the retracted state. When the continuous belt 152 and the contact member 14 circulate, and the contact member 14 is moved downward from the very top pulley 151, the contact member 14 comes in contact with the contact plate 97*a* of each paper-discharge lever 97 in order from the very top paper-discharge lever 97. A paper-discharge guide 9 that is connected to a paper-discharge lever 97 that is no longer in contact with the contact member 14 returns to the retracted state. In other words, each time the contact member 14 passes, the paper-discharge guide 9 pivots around the rotating shaft 99.

The post-processing-control unit 10 causes the belt motor 16 to stop at a position where the paper-discharge guide 9 that corresponds to the bin tray 7 to where paper is to be discharged is in the paper-discharge state. In other words, in order that paper is discharged to the bin tray 7 that is set on the operation panel 4, the post-processing-control unit 10 causes the belt motor 16 to stop at a state in which the paper-discharge lever 97 of the paper-discharge guide 9 that corresponds to the bin tray 7 to which paper is to be discharged and the contact member 14 come contact. FIG. 9 illustrates an example of a state in which the third paper-discharge guide 93 that corresponds to the fourth bin tray 74 is in the paper discharge state. The state in FIG. 9 is a state in which the contact plate 97*a* of the paper-discharge lever 97 that is attached to the third paper-discharge guide 93 and the contact member 14 are in contact. In the state in FIG. 9, paper is discharged to the fourth bin tray 74.

Next, the introduction guide 8 that controls whether or not to introduce paper to the bin-discharge unit 11 (paper-discharge-conveying path 121) will be explained. The introduction guide 8 is provided below the driving pulley 153. The introduction guide 8 rotates and switches the conveying direction of the paper that is being conveyed. FIG. 10 illustrates an example of the introduction guide 8 with an introduction lever 81 attached.

As illustrated in FIG. 7 and FIG. 9, the introduction guide 8 has a rotating shaft 83. The introduction lever 81 is connected to the introduction guide 8 by an introduction-lever-connection unit 82. The introduction-lever-connection unit 82 is a portion in which a tube shaped portion of the introduction lever 81 is fixedly fitted to the rotating shaft 83 on the front side of the introduction guide 8. The introduction guide 8, the introduction lever 81 and the introduction-lever-connection unit 82 are made using resin, for example. The introduction-lever-connection unit 82 (rotating shaft) and the rotating shaft 83 on the other end of the introduction guide 83 (not seen in FIG. 10) are supported by bearings. As a result, the introduction guide 8, the introduction lever 81 and the introduction-lever-connection unit 82 are able to rotate.

An upside down Y-shaped guide plate 84 as seen from the front side is provided on the introduction lever 81. The guide plate 84 comes in contact with the contact member 14 that is circulating, and guides the movement of the contact member 14. When the contact member 14 comes in contact with the introduction lever 81, the contact member 14 pushes the introduction lever 81. In other words, the introduction lever 81 is provided part way along the course of the contact member 14. As a result, the introduction lever 81, the introduction-lever-connection unit 82 and the introduction guide 8 rotate, and the posture of the introduction guide 8 changes.

As illustrated in FIG. 9, when the introduction guide 8 is set to the introducing state in which conveyed paper is introduced into the paper-discharge-conveying unit 12, the introduction lever 81 and the contact member 14 are in a no-contact state. When the guide plate 84 of the introduction lever 81 and the contact member 14 are not in contact, the position of the end section on the right end of the introduction guide 8 that is bent in an arc shape drops due to the introduction guide's 8 own weight. As a result, as illustrated in FIG. 9, the introduction inlet 13 for introducing the paper into the paper-discharge-conveying unit 12 is opened. The conveyed paper is lifted up by the right end section of the introduction guide 8 and enters into the bin-discharge unit 11 (paper-discharge-conveying unit 12).

However, as illustrated in FIG. 7, when the introduction guide 8 is set to the non-introducing state in which the conveyed paper is not guided to the paper-discharge-conveying unit 12, but is guided to another discharge destination (first discharge tray 63), the introduction lever 81 that moves the contact member 14 and the contact member 14 are in a contact state. By the guide plate 84 of the introduction lever 81 coming in contact with the contact member 14, the introduction lever 81 and the introduction guide 8 pivot in the counterclockwise direction as seen from the front side. As a result, the position of the right-end section of the introduction guide 8 that is bent and curved is lifted up. As a result, as illustrated in FIG. 7, the introduction inlet 13 for introducing paper into the paper-discharge-conveying unit 12 becomes closed. This makes it impossible for conveyed paper to advance into the bin-discharge unit 11 (paper-discharge-conveying unit 12). Instead, the paper is conveyed toward the first discharge tray 63 and discharged to the first discharge tray 63.

In the paper discharge apparatus 1, the home position of the contact member 14 is a position where the contact member 14 is in contact with the introduction lever 81, and is positioned below the driving pulley 153 (very bottom pulley 151). A home-position sensor S1 is provided for detecting when the contact member 14 reaches and passes the home position. The home-position sensor S1 is provided further on the front side than the contact member 14, the introduction lever 81 and the driving pulley 153. FIG. 11 illustrates an example of the installation position of the home-position sensor S1. The home-position sensor S1, for example, is a reflecting type or a transmitting type photosensor. The output of the home-position sensor S1 changes depending on when the contact member 14 is or isn't at the home position (the output changes between High level and Low level). The output of the home-position sensor S1 is inputted to the post-processing-control unit 10 (refer to FIG. 3). The post-processing-control unit 10 recognizes whether or not the contact member 14 is at the home position based on the output of the home-position sensor S1.

As illustrated in FIG. 7, FIG. 9 and FIG. 10, the shape of the guide plate 84 of the introduction lever 81 is a circular arc that corresponds to the trajectory of movement of the contact member 14. Moreover, FIG. 7 illustrates a state in which the contact member 14 is positioned at the home position. The contact member 14 that is at the home position pushes the upper section of the introduction lever 81 (guide plate 84), and in this state the right end section of the introduction guide 8 is lifted up a maximum amount.

There is no paper-discharge guide 9 provided for the very top bin tray 7 (first bin tray 71). When the introduction guide 8 is in a dropped state due to its own weight (the contact member 14 and the introduction member 81 are in a no contact state), and when all of the paper-discharge guides 9 are in a retracted state (a state in which the contact member 14 is not in contact with any paper-discharge lever 97), the paper is conveyed to the very top of the paper-discharge-conveying unit 12. The paper is discharged to the first bin tray 71 by a guide that is provided at the very top of the paper-discharge-conveying unit 12.

Next, paper-discharge control by the post-processing-control unit 10 to the bin tray 7 will be explained using FIG. 3. The post-processing-control unit 10, for example, is a circuit board that includes a processing circuit 10*a* such as a CPU that performs calculations, and memory 10*b* such as ROM and RAM. The post-processing-control unit 10 controls the operation of the paper discharge apparatus 1 and a post-processing apparatus 6 based on programs and data for controlling the paper discharge apparatus 1 and post-processing apparatus 6 that are stored in a memory 10*b*.

The main control unit 2 sets the discharge destination for the paper of a job accompanying printing based on settings performed on the operation panel 4 or based on instructions from a person that transmits data for a printer job. The post-processing-control unit 10 recognizes the discharge destination based on the discharge destination instructed by the main control unit 2.

The post-processing-control unit 10 causes the belt motor 16 to rotate when one of the bin trays 7 or the first discharge tray 63 is the discharge destination for the paper. Here, a stepping motor can be used for the belt motor 16. The post-processing-control unit 10 inputs a pulse signal to the belt motor 16 to rotate the belt motor 16, and causes the contact member 14 to move.

(Flow of Paper Discharge Control)

Figure 12:
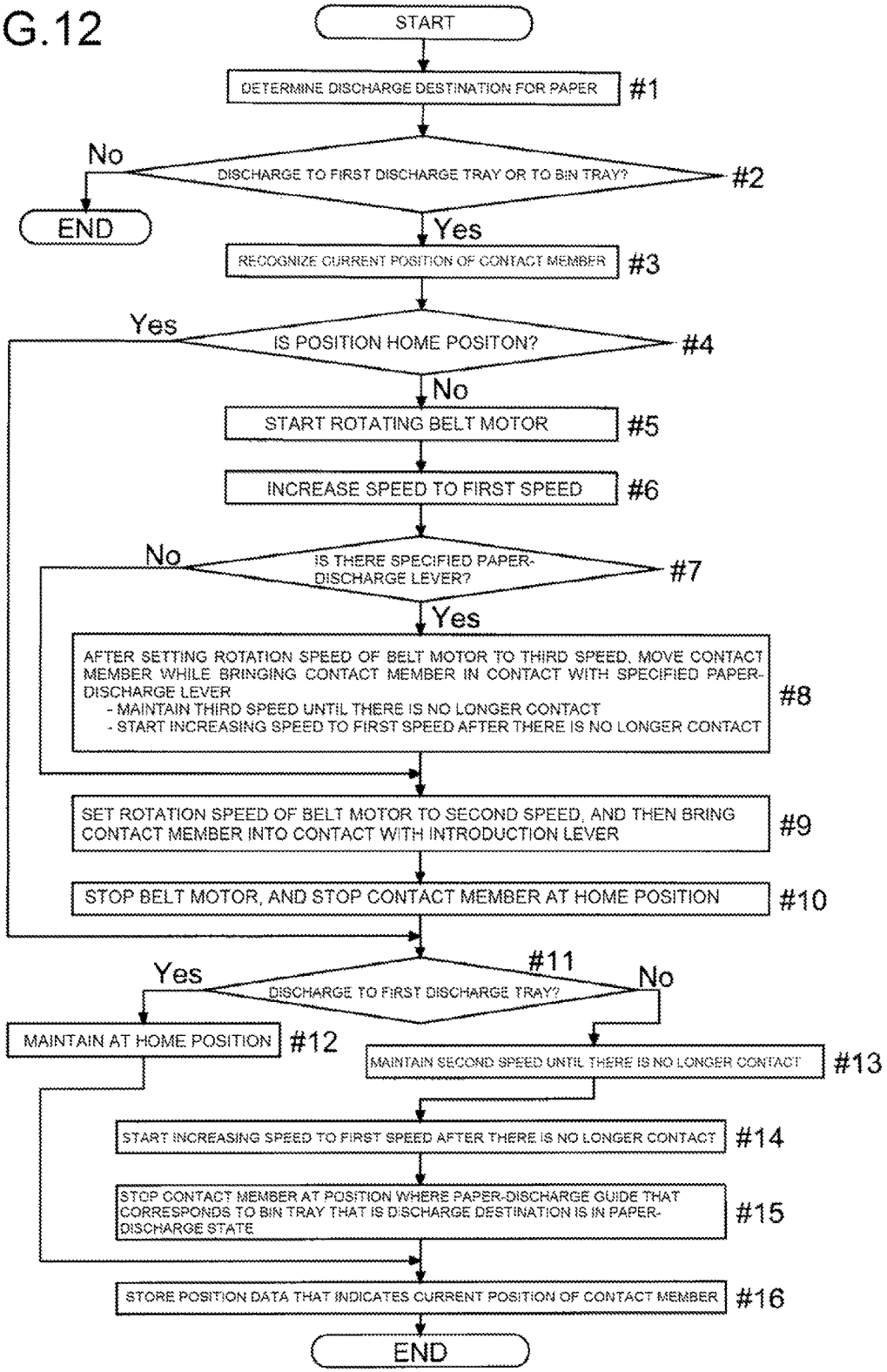
FIG. 12 is a flowchart that illustrates an example of the flow of paper-discharge control by a paper-discharge apparatus of an embodiment.

Next, an example of the flow of paper-discharge control of the paper discharge apparatus 1 (bin-discharge unit 11) of an embodiment will be explained using FIG. 12. FIG. 12 is a flowchart illustrating an example of the flow of paper-discharge control of the paper discharge apparatus 1 of an embodiment.

The start in FIG. 12 is the time at which the main unit of the MFP 100 starts printing. First, the post-processing-control unit 10 determines the discharge destination for the paper of the printing job (step #1). In the case of a copy job, or a job for printing image data that is stored in the storage unit 20 (box printing job), the post-processing-control unit 10 performs communication with the main control unit 2, and recognizes the discharge destination that is set on the operation panel 4. In the case of a print job that is based on printing data that is transmitted from the computer 200, the post-processing-control unit 10 performs communication with the main unit 2, and recognizes the bin tray 7 that is assigned to the person that is printing, or a discharge destination that is set by a computer 200. In this way, the post-processing-control unit 10 performs communication with the control unit 2 and determines the discharge destination for the paper.

Continuing, the post-processing-control unit 10 checks whether or not the discharge destination for the paper is the first discharge tray 63 or one of the bin trays 7 (step #2). In other words, the post-processing-control unit 10 causes the belt motor 16 to rotate, and moves the contact member 14, then checks whether or not it is necessary to change the state of the introduction guide 8 or one of the paper-discharge guides 9 (step #2).

When the discharge destination for the paper is not the first discharge tray 63 or one of the bin trays 7, but is another tray (step #2; NO), it is not necessary to operate a member of the bin-discharge unit 11, so the post-processing-control unit 10 ends this control flow (end).

However, when the discharge destination for the paper is the first discharge tray 63 or one of the bin trays 7, the post-processing-control unit 10 recognizes the current position of the contact member 14 (step #3). When a printing job in which the bin-discharge unit 11 operates ends, position data D1 that indicates the position of the contact member 14 at the time when the printing job ends is stored in the memory 10*b* (refer to step #16 described later and FIG. 3; the position data D1 may also be stored in the storage unit 20). For example, the post-processing-control unit 10 stores the total number of pulses inputted to the belt motor 16 from the home position in the current circulation as position data D1. The post-processing-control unit 10 recognizes the current position of the contact member 14 based on the position data D1 that is stored in the memory 10*b*.

There are cases when it is not possible to recognize and store the current position of the contact member 14. For example, one such case is when the main power supply is turned ON. Moreover, the contact member 14 may move due to work for handling a paper jam (jam). Therefore, when the opening/closing plate 111 is opened and closed, the post-processing-control unit 10 deletes the position data D1. A sensor is provided for detecting when the opening/closing plate 111 is opened and closed. Based on the output of this sensor, the post-processing-control unit 10 recognizes opening and closing of the opening/closing plate 111. When it is not possible to recognize the current position of the contact member 14, the post-processing-control unit 10 causes the contact member 14 to move to the home position at a speed that is slower than during execution of printing.

Next, the post-processing-control unit 10 checks whether or not the contact member 14 is at the home position (step #4). For example, when the position of the contact member 14 that is indicated by the position data D1 is the home position (total number of pulses=zero), and the output value of the home position sensor S1 is at the output level when the presence of the contact member 14 is detected, the post-processing-control unit 10 recognizes that the contact member 14 is at the home position. Moreover, even when the contact member 14 is caused to move to the home position because the current position of the contact member 14 cannot be recognized, the result in step #4 becomes YES.

When the contact member 14 is not at the home position (step #4: NO), processing to temporarily return the contact member 14 to the home position starts. Therefore, the post-processing-control unit 10 starts the rotation of the belt motor 16, and starts to move the contact member 14 to the home position (step #5). Then, the post-processing-control unit 10 increases the rotation speed of the belt motor 16 to a first speed (step #6). The first speed is a speed that is set beforehand as the normal constant speed of rotation of the belt motor 16. In the paper-discharge apparatus 1, a second speed and a third speed are set in advance in addition to the first speed as rotation speeds of the belt motor 16 (explained in detail later).

Continuing, the post-processing-control unit 10 checks whether or not there is a specified paper-discharge lever in the space from the position of the contact member 14 indicated in the position data D1 to the home position (step #7). A specified paper-discharge lever is one or more paper-discharge lever 97 that is set beforehand from among the paper-discharge levers 97. The specified paper-discharge lever is the paper-discharge lever 97 that is set so as to reduce the impact at the time of contact by the contact member 14.

There are cases in which there may be paper-discharge levers 97 or paper-discharge-lever-connection units 98 from among the plural paper-discharge levers 97 that may particularly be damaged easily. For example, the paper-discharge lever 97 and the paper-discharge-lever-connection unit 98 for that paper-discharge lever 97 of a paper-discharge guide 9 that corresponds to a bin tray 7 that is for thick paper that hits against the paper-discharge guide 9 with a strong force may be damaged more easily than a paper-discharge lever 97 and paper-discharge-lever-connection unit 98 of a paper-discharge guide 9 that corresponds to a bin tray 7 for normal paper. By setting such a paper-discharge lever 97 as a specified paper-discharge lever, it is possible to avoid as much as possible the accumulation of damage to the paper-discharge lever 97 and paper-discharge-lever-connection unit 98, and make it more difficult for damage to occur. Moreover, setting which paper-discharge levers 97 from among the paper-discharge levers 97 are to be as specified paper-discharge levers can be performed on the operation panel 4. It is also possible to set all of the paper-discharge levers 97 as specified paper-discharge levers.

When there is a specified paper-discharge lever (step #7: YES), the post-processing-control unit 10 sets the rotation speed of the belt motor 16 for the specified paper-discharge lever to the third speed that is slower than the first speed (the second speed will be described in detail later). Then, while causing the contact member 14 to come in contact with the specified paper-discharge lever, moves the contact member 14 toward the home position (step #8). More specifically, the post-processing-control unit 10 maintains the rotation speed of the motor at the third speed from the start of contact between the contact member 14 and the specified paper-discharge lever until there is no longer contact between the contact member 14 and the specified paper-discharge lever. Then, after there is no contact between the contact member 14 and the specified paper-discharge lever, the post-processing-control unit 10 starts to increase the speed to the first speed (step #8). When there are plural specified paper-discharge levers while moving to the home position, the post-processing-control unit 10 repeats the deceleration and acceleration of the rotation speed of the belt motor 16 plural times.

The third speed is a speed that is slower than the first speed. The third speed can be ⅔ or less than the first speed. The post-processing-control unit 10 changes the rotation speed of the belt motor 16 by changing the frequency of the pulse signal that is inputted to the belt motor 16.

The distance of movement of the contact member 14 (continuous belt 152) from the home position to the point where contact between the specified paper-discharge lever and the contact member 14 starts, or the distance of movement of the contact member 14 from the home position to the point where there is no longer contact between the specified paper-discharge lever and the contact member 14 is fixed. Therefore, the total number of pulses inputted to the belt motor 16 from the home position to where contact between the specified paper-discharge lever and the contact member 14 starts (total number from the home position) can be handled as being fixed. Moreover, the total number of pulses inputted to the belt motor 16 from the home position to the where there is no longer contact between the specified paper-discharge lever and the contact member 14 is also handled as being fixed. Therefore, third-speed-interval data D2 that indicates the interval of the total number of pulses from the home position from when contact between the specified paper-discharge lever and the contact member 14 starts until there is no longer contact between specified paper-discharge lever and the contact member 14 can be stored in the memory 10*b* or in the storage unit 20.

The post-processing-control unit 10 causes the belt motor 16 to rotate at the third speed while the total number of pulses from the home position is within the value of the third-speed-interval data D2. Moreover, before the total number of pulses from the home position during the current circulation reaches the value of the third-speed-interval data D2, or as the total number of pulses reaches the value of the third-speed-interval data D2, the post-processing-control unit 10 sets the rotation speed of the belt motor 16 to the third speed. Therefore, the speed of movement of the contact member 14 when there is contact between the specified paper-discharge lever and the contact member 14 becomes slower than normal.

Moreover, when there is no specified paper-discharge lever (step #7: NO), or after step #8, before the contact member 14 reaches the home position, the post-processing-control unit 10 causes the contact member 14 to come in contact with the introduction lever 81 after changing the rotation speed of the motor to the second speed that is slower than the first speed (step #9). The second speed is a speed that is slower than the first speed. The second speed may be ½ or less than the first speed. The second speed and the third speed may be the same speed, or may be different.

Here, the introduction lever 81 is provided near the very bottom driving pulley 153 of the pulleys 151. Then, the introduction lever 81 and the contact member 14 come in contact in a state in which the contact member 14 moves in an arc shape. In other words, the introduction lever 81 is provided in a position where the contact member 14 comes in contact in the middle of an interval in which the course of the contact member 14 is an arc shape by the pulley 151.

In the interval in which the trajectory of the movement of the contact member 14 is an arc shape, the movement speed of the contact member 14 becomes faster than when the contact member 14 is moving along the straight portion of the continuous belt 152 (becomes faster in proportion to the radius of the arc). There is contact in a state in which the movement speed of the contact member 14 becomes fast, so the impact on the introduction lever 81 and the introduction-lever-connection unit 82, and the twisting force on the introduction-lever-connection unit 82 when lifting up the introduction lever 81 becomes larger than in the case of the paper-discharge lever 97. Through experience it is known that it is easier for the introduction lever 81 and the introduction-lever-connection unit 82 to become damaged than the paper-discharge lever 97 and the paper-discharge-lever-connection unit 98. Therefore, the second speed may be slower than the third speed. For example, the second speed may be the rotation speed at the self-starting frequency of the belt motor 16.

The distance from the home position to the point where contact between the introduction lever 81 and the contact member 14 starts is fixed. Therefore, the circulating movement of the contact member 14 from the home position is started, and the total number of pulses inputted to the belt motor 16 from the point when there is no longer contact between the introduction lever 81 and the contact member 14 until contact between the introduction lever 81 and the contact member 14 starts again is also handled as being fixed. Therefore, the memory 10*b* stores the total number of pulses inputted to the belt motor 16 from the home position until contact between the introduction lever 81 and the contact member 14 starts again (re-contact-pulse value D3) (refer to FIG. 3; the re-contact-pulse value D3 may also be stored in the store unit 20).

Before the total number of pulses from the home position in the current circling movement reaches the re-contact-pulse value D3, or as the total number of pulses reaches the re-contact-pulse value D3, the post-processing-control unit 10 sets the rotation speed of the belt motor 16 to the second speed. Therefore, the speed of movement of the contact member 14 when the introduction lever 81 and the contact member 14 come in contact becomes slower than the normal speed (first speed). As a result, it is possible to reduce the load on the introduction-lever-connection unit 82 when compared with bringing the contact member 14 and the introduction lever 81 in contact at the first speed.

After contact between the member 14 and the introduction lever 81, when it is possible based on the output of the home position sensor S1 to recognize that the contact member 14 has reached the home position, the post-processing-control unit 10 stops the belt motor 16, and stops the contact member 14 at the home position (step #10).

Next, in the case of YES in step #4 (the position of the contact member 14 is at the home position), and after step #10, the post-processing-control unit 10 checks whether or not the discharge destination for the paper is the first discharge tray 63 (step #11). When discharging the paper to the first discharge tray 63 (step #11: YES), the post-processing-control unit 10 maintains the introduction lever 81 and the contact member 14 in a state of contact (state in which the contact member 14 is at the home position) (step #12).

When the paper is to be discharged to one of the bin trays 7 (step #11: NO), the post-processing-control unit 10 starts rotation of the belt motor 16, and maintains the rotation speed of the motor at the second speed until there is no longer contact between the contact member 14 and the introduction lever 81 (step #13). The memory 10*b* stores the number of pulses from the home position until there is no longer contact between the introduction lever 81 and the contact member 14 (no-contact-pulse value D4) (refer to FIG. 3, the no-contact-pulse value D4 may also be stored in the storage unit 20). The post-processing-control unit 10 maintains the rotation speed of the belt motor 16 at the second speed until the total number of pulses inputted to the belt motor 16 from the home position reaches the no-contact-pulse value D4.

After there is no longer contact between the contact member 14 and the introduction lever 81 (after the total number of pulses inputted to the belt motor 16 from the home position exceeds the no-contact-pulse value D4), the post-processing-control unit 10 sets the rotation speed of the belt motor 16 to the first speed (step #14).

The post-processing-control unit 10 stops the contact member 14 at a position where the paper-discharge guide 9 that corresponds to the bin tray 7 of the discharge destination is in the discharge state (position where the paper is discharged to the bin tray 7 of the discharge destination) (step #15). The memory 10*b* stores data (paper-discharge-state data D5) that indicates the total number of pulses from the home position where each paper-discharge guide 9 is in the discharge state (refer to FIG. 3; the paper-discharge-state data D5 may also be stored in the storage unit 20). The post-processing-control unit 10 references the paper-discharge-state data D5 and stops the contact member 14 at a position where the total number of pulses from the home position that are inputted to the belt motor 16 is the number of pulses where the paper-discharge guide 9 corresponding to the bin tray 7 to which paper is to be discharge is in the paper-discharge state.

In the third speed interval that is set, when there is a specified paper-discharge lever in the space from the home position to the stopping position, the rotation speed of the belt motor 16 is set to the third speed. This point is the same as in step #8, so an explanation is omitted. Finally, the post-processing-control unit 10 causes the memory 10*b* to store position data D1 that indicates the current position of the contact member 14 (step #16 end). As a result, it is possible to recognize the position of the contact member 14 at the start of the next movement of the contact member 14 (at the start of rotation of the belt motor 16) (step #3).

In this way, the paper-discharge apparatus 1 of an embodiment includes a paper-discharge-conveying unit 12, an introduction guide 8, an introduction-lever 81, a contact member 14, a movement mechanism 15, a motor (belt motor 16) and a control unit (post-processing-control unit 10). The paper-discharge-conveying unit 12 conveys paper toward the discharge destination. A rotating shaft is provided in the introduction guide 8. The introduction lever 81 is connected to the introduction guide 8 by the introduction-lever-connection unit 82. The contact member 14, when coming in contact with the introduction lever 81, changes the posture of the introduction guide 8 by rotating the introduction lever 81. The movement mechanism 15 moves the contact member 14. The motor moves the movement mechanism 15. The control unit controls the movement and position of the contact member 14 by controlling the motor. When the state of the introduction guide 8 is in the introducing state of guiding conveyed paper into the inside of the paper-discharge-conveying unit 12, the control unit sets the introduction lever 81 and the contact member 14 to the no-contact state, and when the state of the introduction guide 8 is in a non-introducing state, the conveyed paper is not guided to the paper-discharge-conveying unit 12, but is guided to another discharge destination, and the control unit sets the introduction lever 81 and contact member 14 to the contact state. Moreover, the control unit, together with moving the contact member 14 by rotating the motor at a first speed, brings the contact member 14 and the introduction lever 81 into contact after changing the rotation speed of the motor to a second speed that is slower than the first speed.

As a result, it is possible to suppress the impact that is applied to the introduction lever 81 itself and to the connection unit between the introduction guide 8 and the introduction lever 81. Therefore, even though contact between the introduction lever 81 and the contact member 14 is repeated, it is possible to prevent damage to the introduction lever 81 itself and the introduction-lever-connection unit 82, and to extend the life of the paper discharge apparatus 1. Moreover, it is possible to suppress the sound that occurs when the contact member 14 and the introduction lever 81 come in contact. The control unit is also able to reduce the rotation speed of the motor for just the interval that the introduction lever 81 and the contact member 14 are in contact, and basically causes the motor to rotate at the first speed, so it is possible for the paper-discharge apparatus 1 to operate at a sufficient operating speed.

Furthermore, the movement mechanism 15 includes a continuous belt 152, and plural pulleys 151 around which the continuous belt 152 is placed. The motor rotates one of the pulleys 151. The contact member 14 is provided on the continuous belt 152. The introduction lever 81 is provided part way along the course of the contact member 14. In the introducing state, by allowing the introduction guide 8 to lower under its own weight with the contact member 14 and the introduction lever 81 not in contact, the control unit opens the introduction inlet 13 to the paper-discharge-conveying unit 12 for the conveyed paper. In the non-introducing state, the control unit causes the introduction guide 8 to rotate in a direction that lifts up the introduction guide 8 and brings the contact member 14 and introduction lever 81 into contact, which causes the introduction inlet 13 to close. The introduction guide 8 has enough weight to open or close the introduction inlet 13 under it own weight, so when the contact member 14 is moved at high speed and the introduction guide 8 is rotated at high speed, a large twisting force is applied to the introduction-lever-connection unit 82. However, in the present disclosure, even though the introduction guide 8 is made to rotate repeatedly, it is possible to prevent damage to the introduction-lever-connection unit 82.

In the belt that is placed around the pulleys 151, the circling speed of the belt is the same in the straight portions and the arc portions. The contact member 14 is provided on the belt and the trajectory of movement of the contact member 14 in the arc portions is circular, so the distance of movement of the contact member 14 in a certain unit time becomes longer than the belt. In other words, the speed of movement of the contact member 14 become faster when moving through the arcs than when moving along the straight portions (the speed increases proportional to the radius of the arc). Moreover, the introduction lever 81 is provided at a position that comes in contact with the contact member 14 in the middle of the interval where the course of the contact member 14 by the pulley 151 is an arc shape. As a result, in an interval where the speed of movement of the contact member 14 becomes fast, it is possible to reduce the speed of movement of the contact member 14 and suppress impact that is applied to the introduction lever 81 and the introduction-lever-connection unit 82.

Moreover, the control unit causes the motor to rotate at the second speed from the start of contact between the contact member 14 and the introduction lever 81 until there is no longer contact between the contact member 14 and the introduction lever 81, and then moves the contact member 14 and starts increasing the speed to the first speed after there is no longer contact with the introduction lever 81. As a result, it is possible to suppress the force applied to the introduction lever 81 and the introduction-lever-connection unit 82 all the way from the start to the end of contact, and thus it is possible to prevent further damage from occurring.

Furthermore, the second speed is half or less than the first speed. As a result, it is possible to reduce the force that is applied to the introduction lever 81, and to the connection unit that connects the introduction lever 81 and the introduction guide 8. Moreover, it is possible to suppress sound that occurs during contact between the introduction lever 81 and the contact member 14.

Furthermore, the paper-discharge apparatus 1 according to an embodiment includes as the discharge destination, plural bin trays 7, plural paper-discharge guides 9 and plural paper-discharge levers 97. The bin trays 7 are provided so as to be arranged along the paper-conveying path of the paper-discharge-conveying unit 12. The paper-discharge guide 9 is provided with a rotating shaft, and switches the conveying direction of the paper that is introduced in the paper-discharge-conveying unit 12 in the direction toward the bin trays 7. The paper-discharge lever 97 is connected to the paper-discharge guide 9 by a paper-discharge-lever-connection unit 98. Each paper-discharge lever 97 is provided in the middle of the trajectory of the contact member 14. The control unit rotates the paper-discharge lever 97 that is in contact with the contact member 14, and changes the paper-discharge guide 9 that is connected to the paper-discharge lever 97 that is in contact with the contact member 14 from a retracted state that does not change the conveying direction of the paper to a discharge state that changes the conveying direction of the paper. The control unit causes the paper-discharge lever 97 that is connected to the paper-discharge guide 9 that corresponds to the bin tray 7 to which the paper is to be discharged to come in contact with the contact member 14. When moving the contact member 14, the control unit brings the contact member 14 in contact with one or plural specified paper-discharge levers that are paper-discharge levers 97 that are preset from among the paper-discharge levers 97 after changing the rotation speed of the motor to a third speed that is slower than the first speed.

As a result, it is possible to suppress impact that is applied to the paper-discharge lever 97 that is connected to the paper-discharge guide 9 for discharging paper to a specified bin tray 7. Therefore, even when the contact between the paper-discharge lever 97 and the contact member 14 is repeated, it is possible to prevent damage to the paper-discharge lever 97 itself and to the portion that connects the paper-discharge guide 9 and the paper-discharge lever 97 (paper-discharge-lever-connection unit 98), and it is possible to extend the life of the paper-discharge apparatus 1. Moreover, it is possible to suppress the sound that occurs during contact between the contact member 14 and the paper-discharge lever 97. Furthermore, the control unit reduces the rotation speed of the motor in the interval that the specified paper-discharge lever and the contact member 14 are in contact, and basically rotates the motor at the first speed, so it is possible for the paper-discharge apparatus 1 to operate at a sufficient operating speed.

Furthermore, the control unit maintains the rotation speed of the motor at the third speed from that start of contact between the contact member 14 and the specified paper-discharge lever until there is no longer contact between the contact member 14 and the specified paper-discharge lever, and starts increasing the speed to the first speed after there is no longer contact with the specified paper-discharge lever. As a result, it is possible to suppress the force applied to the paper-discharge lever 97 and the paper-discharge-lever-connection unit 98 during the entire period from the start to the end of contact, and it is possible to prevent any further damage.

Furthermore, the image-forming apparatus (MFP 100) includes the paper-discharge apparatus 1 described above. As a result, even when the contact between a lever and the contact member 14 is repeated, the lever itself and the connection unit between a guide and lever is not damaged, so it is possible to extend the life of the image-forming apparatus. Moreover, it is possible to suppress sound during contact between the contact member 14 and a lever, and thus it is possible to provide a quiet image-forming apparatus.

In a typical paper-discharge apparatus, guides are provided for switching the discharge destination (conveying direction) of the paper. When one solenoid is provided for each guide, suppressing the manufacturing cost is difficult. Therefore, in a paper-discharge apparatus, controlling the posture of a guide by applying force to the guide by moving a protrusion and bringing a posture-control member that is provided on the guide in contact with the protrusion may be performed. For example, when in a state in which there is no contact between the protrusion and the posture-control member, the guide has a posture that allows paper to pass (lets the paper go by). When the protrusion and posture-control member are in contact and the guide rotates, the guide is in a posture for guiding the paper to a corresponding bin tray.

In recent years, in order to speed up processing, the speed of movement of the protrusion may be increased more than before. The faster the movement speed of the protrusion is, the larger the impact that is applied to the guide (the impact force is proportional to the square of the speed) becomes. As large impact loads are repeatedly applied, damage is accumulated. For example, at first a small crack occurs, the crack gradually becomes larger, and finally there is a problem in that damage occurs such as a portion of the posture-control member breaking or becoming detached. Moreover, the faster the movement speed of the protrusion is, the larger the sound that occurs during contact between the protrusion and the posture-control member becomes. However, by slowing the movement speed of the protrusion, operation of the paper-discharge apparatus becomes slow.

According to the present disclosure, it is possible to provide a paper-discharge apparatus that does not have breakage of parts that come in contact with a member that is attached to a guide and that moves in order to change the posture of the guide. Moreover, it is possible to provide a paper-discharge apparatus that suppresses the operating sound.

The range of the present disclosure is not limited by the explanation of the embodiments, and it is possible to add various modifications within a range that does not depart from the spirit of the disclosure.

The technology of the present disclosure can be used in a paper-discharge apparatus and an image-forming apparatus that includes a paper-discharge apparatus.

What is claimed is:

1. A paper-discharge apparatus comprising:

a paper-discharge-conveying unit that conveys paper toward a discharge destination;

an introduction guide that is provided with a rotating shaft;

an introduction lever that is connected with the introduction guide by an introduction-lever-connection unit;

a contact member that changes the posture of the introduction guide by causing the introduction lever to rotate when coming in contact with the introduction lever;

a movement mechanism that causes the contact member to move;

a motor that moves the movement mechanism; and a control unit that controls the movement and position of the contact member by controlling the motor, and when the state of the introduction guide is set to an introducing state in which conveyed paper is introduced to the paper-discharge-conveying unit, the control unit sets the introduction lever and the contact member to a no-contact state, and when the state of the introduction guide is in a non-introducing state in which conveyed paper is not guided to the paper-discharge-conveying unit, but is guided to another discharge destination, the control unit sets the introduction lever and contact member to a contact state, and together with rotating the motor at a first speed and causing the contact member to move, causes the contact member to come in contact with the introduction lever after changing the rotation speed of the motor to a second speed that is slower than the first speed.

2. The paper-discharge apparatus according to claim 1, wherein the movement mechanism includes a continuous belt and plural pulleys around which the continuous belt is placed;

the motor rotates the pulleys;

the contact member is provided on the continuous belt;

the introduction lever is provided part way along the course of the contact member;

in the introducing state, the control unit opens an introduction inlet to the paper-discharge-conveying unit for the conveyed paper by allowing the introduction guide to lower under its own weight with the contact member and the introduction lever in the non-contact state; and in the non-introducing state, the control unit closes the introduction inlet by causing the contact member and the introduction lever to come in contact, causing the introduction guide to rotate in a direction that lifts up the introduction guide.

3. The paper-discharge apparatus according to claim 1, wherein the introduction lever is provided in a position that is in the middle of an interval where the course of the contact member by the pulley becomes an arc shape, and that comes in contact with the contact member.

4. The paper-discharge apparatus according to claim 1, wherein the control unit moves the contact member by rotating the motor at the second speed from the start of contact between the contact member and the introduction lever and until there is no longer contact between the contact member and the introduction lever, and starts increasing the speed to the first speed after there is no longer contact with the introduction lever.

5. The paper-discharge apparatus according to claim 1, wherein the second speed is one half or less than the first speed.

6. The paper-discharge apparatus according to claim 1, including:

plural bin trays that are provided so as to be arranged along a paper-discharge-conveying path of the paper-discharge-conveying unit as the discharge destination;

plural paper-discharge guides that are provided with a rotating shaft and that switch the conveying direction of the paper conveyed by the paper-discharge-conveying unit to a direction toward the bin trays; and plural paper-discharge levers that are connected to the paper-discharge guides by paper-discharge-lever-connection units; wherein each paper-discharge lever is provided part way along the course of the contact member;

the control unit rotates the paper-discharge lever that is in contact with the contact member, and changes the paper-discharge guide that is connected to the paper-discharge lever that is in contact with the contact member from a retracted state that does not change the conveying direction of the paper to a paper-discharge state that changes the conveying direction of the paper; and when the control unit brings the paper-discharge lever that is connected to the paper-discharge guide that corresponds to the bin tray to which the paper is to be discharged in contact with the contact member and causes the contact member to move, the control unit causes the contact member to come in contact with a specified paper-discharge lever that is one or more paper-discharge lever that is preset from among the paper-discharge levers after changing the rotation speed of the motor to a third speed that is slower than the first speed.

7. The paper-discharge apparatus according to claim 6, wherein the control unit maintains the rotation speed of the motor at the third speed from the start of contact between the contact member and the specified paper-discharge lever and until there is no longer contact between the contact member and the specified paper-discharge lever, and starts to increase the speed to the first speed after there is no longer contact with the specified paper-discharge lever.

8. An image-forming apparatus that includes the paper-discharge apparatus according to claim 1.

* * * * *